US010982500B2

(12) United States Patent
Pan et al.

(10) Patent No.: US 10,982,500 B2
(45) Date of Patent: Apr. 20, 2021

(54) TRANSDUCER ASSEMBLY FOR OFFSHORE DRILLING RISER

(71) Applicants: Hydril USA Distribution LLC, Houston, TX (US); Chuanlin Pan, ChengDu (CN); Heng Yang, ChengDu (CN); Xing Yu, Sichuan (CN); Bing Pu, Sichuan (CN); Jing Ye, Shanghai (CN); Weihua Shang, Shanghai (CN); Heng Wu, Shanghai (CN); Ran Niu, Shanghai (CN)

(72) Inventors: Chuanlin Pan, ChengDu (CN); Heng Yang, ChengDu (CN); Xing Yu, Sichuan (CN); Bing Pu, Sichuan (CN); Jing Ye, Shanghai (CN); Weihua Shang, Shanghai (CN); Heng Wu, Shanghai (CN); Ran Niu, Shanghai (CN)

(73) Assignee: HYDRIL USA DISTRIBUTION LLC, Houston, TX (US)

( * ) Notice: Subject to any disclaimer, the term of this patent is extended or adjusted under 35 U.S.C. 154(b) by 0 days.

(21) Appl. No.: 16/327,177

(22) PCT Filed: Aug. 26, 2016

(86) PCT No.: PCT/CN2016/096856
§ 371 (c)(1),
(2) Date: Feb. 21, 2019

(87) PCT Pub. No.: WO2018/035840
PCT Pub. Date: Mar. 1, 2018

(65) Prior Publication Data

US 2019/0218877 A1 Jul. 18, 2019

(51) Int. Cl.
*E21B 33/037* (2006.01)
*E21B 47/01* (2012.01)
(Continued)

(52) U.S. Cl.
CPC ..... *E21B 33/037* (2013.01); *E21B 34/16* (2013.01); *E21B 47/01* (2013.01); *E21B 47/12* (2013.01)

(58) Field of Classification Search
CPC ..... E21B 33/037; E21B 34/16; E21B 47/01; E21B 47/12
See application file for complete search history.

(56) References Cited

U.S. PATENT DOCUMENTS 4,027,399 A 6/1977 Armstrong et al.
10,443,375 B2 * 10/2019 Nguyen ..... G01V 1/44
(Continued)

FOREIGN PATENT DOCUMENTS

CN 102758619 A 10/2012
CN 204402463 U 6/2015
(Continued)

OTHER PUBLICATIONS

PCT Search Report and Written Opinion issued in connection with corresponding Application No. PCT/CN12016/096856 dated Jun. 8, 2017.

*Primary Examiner* — James G Sayre
(74) *Attorney, Agent, or Firm* — Baker Hughes Patent Operation

(57) ABSTRACT

Transducer assembly for an offshore drilling riser, in an example, includes a spool for connecting into the riser and a protrusion extending around the side wall of the spool. A recess extends around the protrusion between upper and lower sloping surfaces. Upper transducer bores are spaced around the protrusion and extend from the upper sloping surface downward and inward into the spool bore and lower transducer bores extend from the lower sloping surface upward and inward into the spool bore. A base of a rigid non-metallic material is located in each of the transducer bores. A seal ring extends around a cylindrical exterior portion of each of the bases and one of the transducer bores.
(Continued)

An acoustic transducer element is mounted to the outer end of each of the bases. The transducer assembly can detect drilling fluid and form sealing.

20 Claims, 4 Drawing Sheets

(51) Int. Cl.
*E21B 47/12* (2012.01)
*E21B 34/16* (2006.01)

(56) References Cited

U.S. PATENT DOCUMENTS

2004/0154390 A1* 8/2004 Baustad ..... E21B 47/01 73/152.55
2005/0100414 A1* 5/2005 Salama ..... E21B 17/01 405/224.2
2006/0115335 A1* 6/2006 Allen ..... E21B 17/01 405/274
2010/0008190 A1* 1/2010 Gray ..... E21B 21/08 367/83
2015/0292317 A1* 10/2015 Flores ..... E21B 47/10 166/250.01
2017/0102253 A1* 4/2017 Ye ..... G01F 1/662
2017/0328152 A1* 11/2017 Jaffrey ..... E21B 21/08
2017/0343397 A1* 11/2017 Ye ..... G01F 1/662

FOREIGN PATENT DOCUMENTS

CN 204827417 U 12/2015
CN 204827423 U 12/2015
EP 2415959 A2 2/2012
WO 2014001249 A1 1/2014

* cited by examiner

TRANSDUCER ASSEMBLY FOR OFFSHORE DRILLING RISER

FIELD OF INVENTION

This disclosure relates in general to offshore well drilling risers, and in particular to an apparatus having a spool that connects into the riser and transducers for detecting movement within, such as drilling fluid flow and drill string threaded connector joints.

BACKGROUND OF THE INVENTION

During offshore well drilling, the operator will employ a drilling riser between a subsea wellhead and the drilling platform. A blowout preventer (BOP) connects between the drilling riser and the subsea wellhead to control pressure encountered in the well. During drilling, a drill string extends through the drilling riser, BOP, and subsea wellhead into the well. The operator pumps drilling fluid down the drill string while rotating the drill bit. The drilling fluid returns up an annulus along with earth formation cuttings. Normally, the drilling fluid flows up the riser around the drill string.

At times, unexpected pressure can occur within the well, causing a pressure kick. If not controlled, the pressure kick could lead to a blowout. Various techniques are proposed for early detection of pressure kicks. One technique proposed would employ a flow meter near the subsea well housing to detect the flow rate of the drilling fluid flowing up the annulus around the drill string. The flow meter has to be able to withstand high pressure and temperature in a subsea location that may be thousands of feet from the drilling platform. Flow meter arrangements to monitor flow in a drilling riser near a subsea wellhead are not yet in common current use.

There are many types of flow meters generally. One type is an ultrasonic transducer that may be used to obtain velocity information of a fluid based on ultrasonic echography and Doppler theory. The transducer emits a pulsed ultrasonic wave into a fluid. Impurities and contaminations in the fluid reflect the wave, and the transducer receives the echo. Doppler theory allows for velocity calculation by a known formula.

SUMMARY OF INVENTION

An apparatus for an offshore drilling riser includes a spool having connectors on upper and lower ends for connecting into the riser. The spool has a side wall with a spool bore and a longitudinal spool axis. A first band extends around an exterior of the side wall concentric with the axis and formed as part of the side wall. The first band has a first band upper side that faces upward and outward relative to the spool axis. The first band has a first band lower side that faces downward and outward relative to the spool axis. The upper and lower sides may be conical. A plurality of first band transducer bores extend from one of the upper and lower sides through the first band and to the spool bore. Each of the first band transducer bores has a transducer bore axis that is oblique relative to the spool bore axis. A first band transducer mounts in each of the transducer bores serves to detect a parameter of drilling fluid flowing through the spool bore.

A cable passage extending axially from each of the first band transducer bores has an outlet on an exterior portion of the spool. A transducer cable extending from each of the first band transducers into one of the cable passages supplies power to and transmits signals to and from each of the first band transducers. In the embodiment shown, all of the first transducer bores extend downward and inward from the first band upper sloping side.

A second band extends around the exterior of the side wall below the first band concentric with the axis and integrally formed as part of the side wall. The second band has a second band upper side that faces upward and outward relative to the spool axis. The second band has a second band lower side that faces downward and outward relative to the spool axis. A plurality of second band transducer bores extend upward and inward from the second band lower side through the second band and to the spool bore. Each of the second band transducer bores has a transducer bore axis that is oblique relative to the spool bore axis. A second band transducer is mounted in each of the second band transducer bores for detecting the flow rate of drilling fluid flowing through the spool bore. The lower side of the first band joins the upper side of the second band in a valley that may define an annular groove between the first and second bands.

In the example shown, a rib or third band is axially spaced from the first and second bands. The rib extends around the exterior of the side wall and is formed as part of the side wall. The rib has upper and lower sides that face upward and downward, respectively, and are joined by an external cylindrical surface. A plurality of rib transducer bores extend radially inward from the cylindrical surface through the rib to the spool bore. Each of the rib transducer bores has a transducer bore axis that is on a radial line of the spool bore axis. A rib transducer mounts in each of the rib transducer bores for detecting a presence of a drill pipe connector within the spool bore.

A cable passage extends axially from each of the first band transducer bores through the side wall of the spool and has an outlet on one of the flat sides of the rib. The outlet is located circumferentially between adjacent ones of the rib transducer bores. A transducer cable extends from each of the first band transducers through one of the cable passages for supplying power to and transmitting signals from each of the first band transducers.

A cylindrical base of a rigid non-metallic material has an inner end at the spool bore and an outer end within one of the first band transducer bores. A transducer element mounts on the outer end of the base.

A seal ring extends around and seals between a cylindrical exterior portion of the base and one of the first band transducer bores. A transducer retainer secures to the outer end of the base and encloses the transducer element of the first band transducer. A cap secures to an outer end of each of the first band transducer bores, the cap having a closed end spaced outward from the transducer retainer.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only one example of the disclosure and is therefore not to be considered limiting of its scope as the disclosure may admit to other equally effective embodiments.

DETAILED DESCRIPTION

Figure 1:
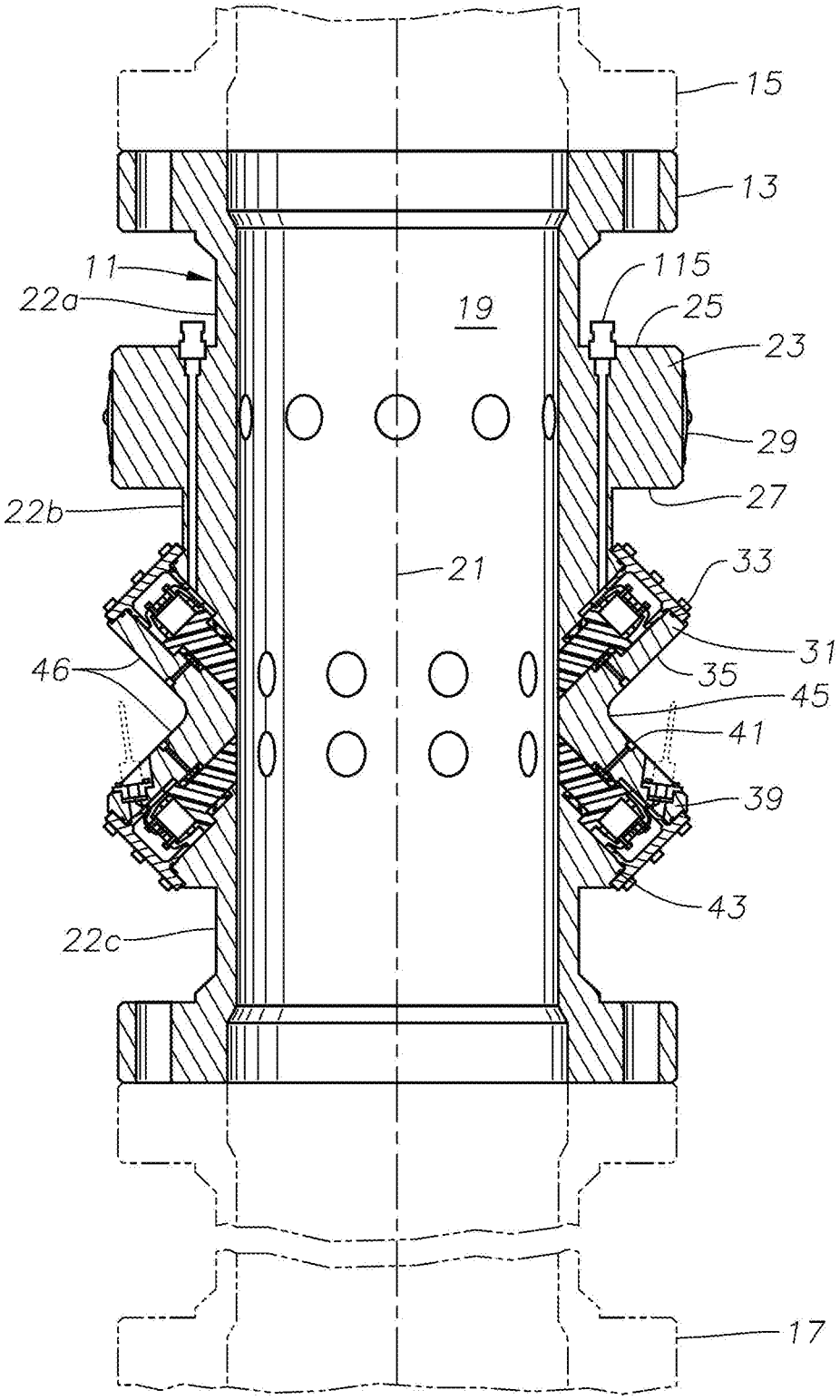
FIG. 1 is a sectional view of a transducer apparatus connected into an offshore well drilling riser.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a tubular housing or spool 11 has connectors 13 at the upper and lower ends for connecting into a string of riser 15. Connectors 13 may be of various types and are shown as external flanges that bolt to flanges on the sections of riser 15. Riser 15 secures to the upper end of a blowout preventer 17 (schematically shown), which is a large complex unit having rams and other elements for closing off flow through the riser. Riser 15 extends upward to a drilling platform (not shown) at the surface. Spool 11 will be connected into riser 15 near the sea floor and a relative short distance above BOP 17.

Spool 11 has a spool bore 19 through which drilling equipment lowered from a surface drilling platform passes. The drilling equipment includes a drill string (not shown) comprising sections of drill pipe having threaded ends, referred to as tool joints, that secure together. Drilling fluid pumped down the drill string flows back up an annulus surrounding the drill string and through spool bore 19 and up riser 15. Spool bore 19 is cylindrical, of constant inner diameter in this example, and has an axis 21 that is vertical after spool 11 is connected into riser 15.

In this example, spool 11 has an upper cylindrical exterior portion 22*a*, an intermediate cylindrical exterior portion 22*b*, and a lower cylindrical exterior portion 22*c*. Intermediate cylindrical exterior portion 22*b* may have a greater outer diameter than portions 22*a* and 22*c*, as shown. The wall thickness of spool 11 at intermediate cylindrical exterior portion 22*b* is greater in this example than the wall thicknesses at exterior portions 22*a* and 22*c*. An annular upper protrusion 23, which may be referred to as a band or a rib, extends outward from the exterior of spool 11 between upper cylindrical exterior portion 22*a* and intermediate cylindrical exterior portion 22*b*. Upper rib 23 is integrally formed with the side wall of spool 11. Upper rib 23 has a flat upper surface 25 and a flat lower surface 27, both of which are in planes perpendicular to spool bore axis 21. Upper rib 23 has a cylindrical exterior 29 that joins upper and lower surfaces 25, 27 to each other and has a larger outer diameter than spool cylindrical exterior portions 22*a*, 22*b* and 22*c*. In this example, the outer diameter of upper rib cylindrical exterior 29 is slightly larger than the outer diameter of connectors 13.

An annular intermediate protrusion, band or rib 31 is located below upper rib 23 at the lower end of spool cylindrical exterior portion 22*b* and protrudes outward from it. Intermediate rib 31 has an upper sloping side 33 and a lower sloping side 35, each of which may be conical. Conical upper side 33 faces upward and outward relative to spool axis 21 at an angle of 45 degrees in this example. Conical lower side 35 faces downward and outward relative to spool axis 21 at an angle of 45 degrees in this example. The upper edge of conical upper side 33 joins spool cylindrical exterior portion 22*b*. Conical upper side 33 and conical lower side 35 have outer edges that join each other at an apex that may be sharp and in a plane perpendicular to spool axis 21. The outer diameter of conical upper side 33 and conical lower side 35 at the outer edge junction may be approximately the same as the outer diameter of upper rib cylindrical portion 29. The angle between conical upper side 33 and conical lower side is 90 degrees in this embodiment.

An annular lower protrusion, band or rib 39 is located below intermediate rib 31 and at the upper end of spool exterior portion 22*c*. Lower rib 39 has an upper sloping side 41 and a lower sloping side 43, each of which may be conical. In this example, conical upper side 41 faces upward and outward at a 45 degree angle relative to spool axis 21 in this example. Conical lower side 43 faces downward and outward at a 45 degree angle relative to spool axis 21 in this example. At these angles, conical upper and lower sides 41, 43 are at 90 degrees relative to each other and intersect at an apex that has the same outer diameter as intermediate rib 31. Apex angles other than 90 degrees are feasible. Lower rib conical upper side 41 joins upper rib conical lower side 35, forming a V-shaped valley or annular recess 45 that has a radius. The included angle 46 between upper side 41 and lower side 35 is 90 degrees in this example, but other angles are feasible. The outer diameter at the base of recess 45 is greater than the outer diameters of spool exterior portions 22*a*, 22*c*, but slightly less than portion 22*b* in this example. Intermediate and lower ribs 31, 39 may be considered to comprise a signal annular protrusion with annular V-shaped recess 45 formed in it.

Figure 2:
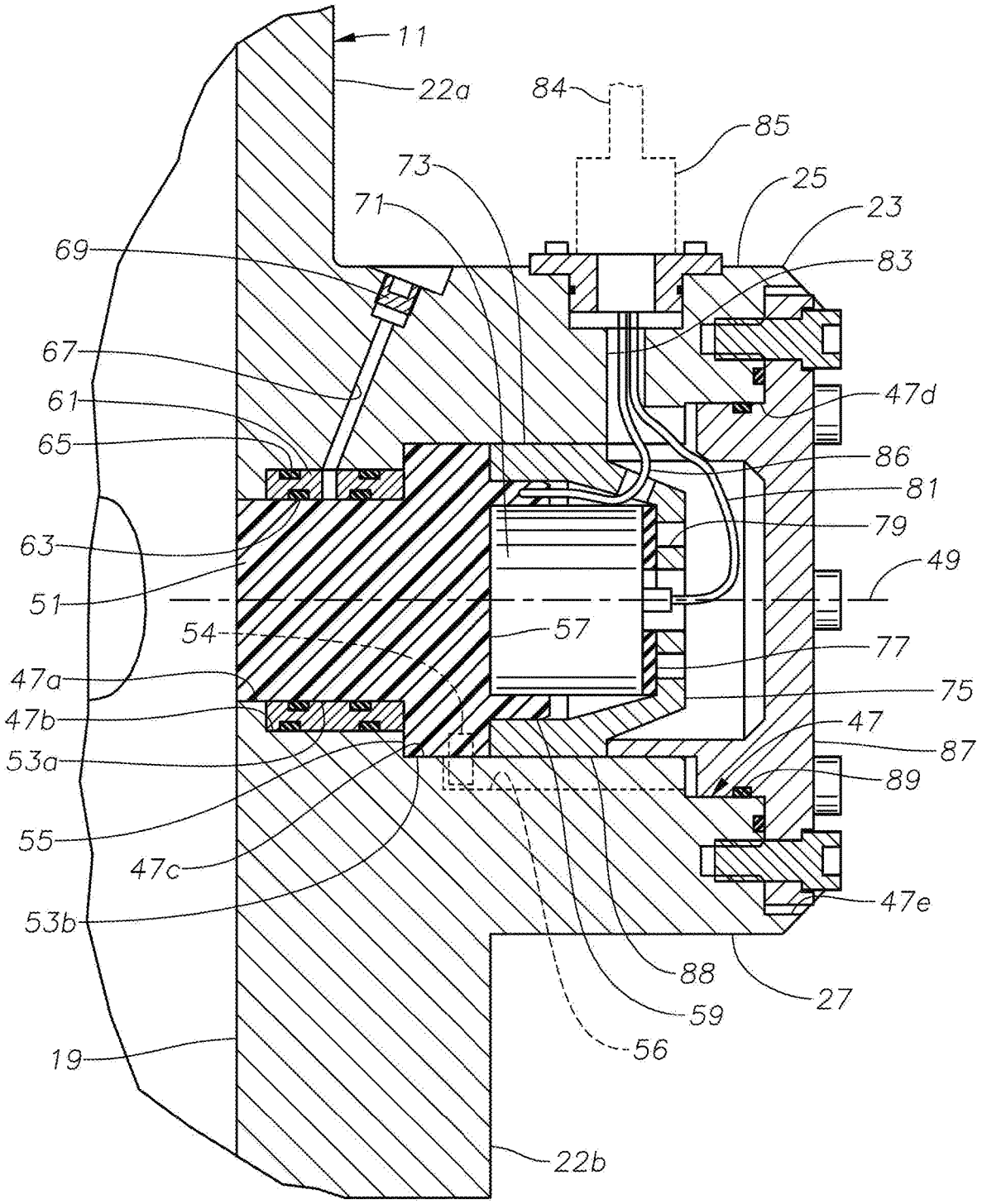
FIG. 2 is an enlarged sectional view showing an upper transducer or measuring device of the transducer apparatus of FIG. 1.

Referring to FIG. 2, a plurality (only one shown) of upper transducer bores 47 are formed in upper rib 23 spaced apart from each other around the circumference of upper rib 23. Because of the different sectional planes in FIG. 1 and FIG. 2, upper transducer bores 47 are not shown in FIG. 1. In this embodiment, each upper rib transducer bore 47 has a number of counter bores, including counter bores 47*a*, 47*b*, 47*c*, 47*d* and 47*e*. The inner diameters of counter bores 47*a*, 47*b*, 47*c*, 47*d* and 47*e* increase in an outward direction from spool bore 19. Each transducer bore 47 has a transducer bore axis 49 that is on a radial line of spool bore axis 21 (FIG. 1).

A thermal barrier or plug, also referred to as a base 51, is mounted in upper rib transducer bore 47. Base 51 is formed of a rigid non-metallic polymeric material having a high temperature resistance, such as 200 degrees C. Also, the material selected is suitable for transmitting acoustic signals into drilling fluid within spool bore 19 and receiving reflected acoustic signals. For example, the material may be selected from the group consisting of polyetheretherketone (PEEK), polytetrafluoroethene (PTFE), fluorinated ethylene propylene (FEP), and combinations thereof.

Base 51 is a solid cylindrical member with an inner end external cylindrical portion 53*a* and an outer end external cylindrical portion 53*b*. Inner end cylindrical portion 53*a* is positioned within transducer bore portions 47*a*, 47*b*, and outer end cylindrical portion 53*b* fits closely within transducer bore portion 47*c*. An inward facing shoulder 55 on base 51 between inner end cylindrical portion 53*a* and outer end cylindrical portion 53*b* abuts a mating outward facing shoulder between transducer bore portions 47*b* and 47*c*. An anti-rotation pin 54 protrudes radially from outer end cylindrical portion 53*b* and inserts into a slot 56 to prevent rotation of base 51 in upper transducer bore 47. Slot 56 extends inward from a shoulder between bore portion 47*c* and 47*c*. The inner end of base 51 may be generally flush with the junction of upper transducer bore 47 and spool bore 19 and normal to upper transducer bore axis 49. The inner end cylindrical portion 53*a* of base 51 fits closely within transducer bore portion 47*a*. Base 51 has an outward facing outer end 57 with an outward protruding cylindrical flange 59 that defines a cylindrical recess within flange 59. Flange 59 is concentric with upper transducer bore axis 49. The outer diameter of flange 59 may be less than the outer diameter of base outer end cylindrical portion 53*b*, as shown.

A seal carrier 61 encircles base inner end cylindrical portion 53*a* and has an inner end that abuts an outward facing shoulder between transducer bore portions 47*a* and 47*b*. Seal carrier 61 has on its outer diameter two elastomeric seal rings 63 that seal between seal carrier 61 and upper transducer bore portion 47*b*. Seal carrier 61 has on its inner diameter two elastomeric seal rings 65 that seal between seal carrier 61 and base cylindrical portion 53*a*. A test port 67 leads outward from the spaces between seal rings 63 and seal rings 65 to a test fitting 69 at upper rib upper surface 25. Fluid may be injected through fitting 69 into test port 67 to test whether seal rings 63, 65 are properly sealing. During drilling, the pressure of the drilling fluid in spool bore 19 will normally be much higher than the pressure at the outer end 57 of base 53, which may be atmospheric.

An acoustic transducer wafer or element 71 fits within the recess formed by base flange 59. Transducer element 71 is a piezoelectric device that both emits and receives acoustic signals through base 51 in this embodiment. An acoustic compliant layer (not shown) may be located between transducer element 71 and base outer end 57.

In this example, the acoustic signals are used to detect the presence in spool bore 19 of a threaded tool joint connector (not shown) of the drill string. Conventional tool joints have larger outer diameters than the portion of drill string above and below. The acoustic signals impinge on the drill string and reflect back to transducer element 71, with the elapsed time being measured to determine the radial distance to the drill string. The radial distance indicates whether or not a tool joint is present.

Base 51 serves to retard heat transfer from the drilling fluid to transducer element 71. Base 51 has a greater resistance to heat transfer than the steel body of spool 11. The axial length of base 51 along axis 49 may vary. In this example, the distance from the inner end of base 51 to outer end 57 is about the same as the wall thickness of spool 11 at spool exterior portion 22*b*.

A transducer retainer or housing 73 encloses but does not seal around transducer element 71. Transducer housing 73 has a cylindrical interior into which base flange 59 slides. The inner end or rim of transducer housing 73 abuts an outward facing rim on base 51 that encircles flange 59. Screws (not shown) extend through transducer housing 73 into the portion of base 51 surrounding flange 59 to secure transducer housing 73 to base 51. Transducer housing 73 has an outer end 75 that locates outward from the outer end of transducer element 71. In this example, a soft compliant washer 77 fits and is compressed in the space between housing outer end 75 and the outer end of transducer element 71. Screws (not shown in FIG. 2) extend through housing outer end 75 and push transducer element 71 tightly against base outer end 57 to ensure good acoustic performance. Transducer housing outer end 75 has two threaded holes 79 for receiving a tool (not shown) that may be used to pull base 51, transducer element 71 and transducer housing 73 as a unit from transducer bore 47.

A transducer power and signal cable 81 extends from the outer end of transducer element 71 through a hole in housing outer end 75. A cable passage 83 extends from transducer bore portion 47*c* upward to upper surface 25 of upper rib 23. Cable passage 83 is parallel to spool bore axis 21 (FIG. 1) in this example. A conventional subsea cable connector 85 may be secured and sealed to the outlet of cable passage 83. A temperature sensor may be embedded in base 51. The wire 86 for the temperature sensor also extends into cable passage 83. Cable 81 and the wire 86 of the temperature sensor join cable connector 85 and connect with one or more external cables 84 located on the outer side of spool 11. Connector 85 also seals from sea water leakage into cable passage 83 and the space around housing 73.

A cap 87 secures by threaded fasteners to the outer end of upper transducer bore 47 outward from transducer housing outer end 75. Cap 87 may have a cylindrical inward facing shoulder 88 that abuts an outward facing shoulder on transducer housing 73. Cap 87 prevents base 51 and transducer housing 73 from moving outward in response to high pressure within spool bore 19. The outer periphery of cap 87 fits within transducer bore portion 47*e*. A seal 89 on cap 87 seals the portion of upper transducer bore 47 outward from seal rings 63, 65 against sea water by sealing engagement with bore portion 47*d*.

Figure 3:
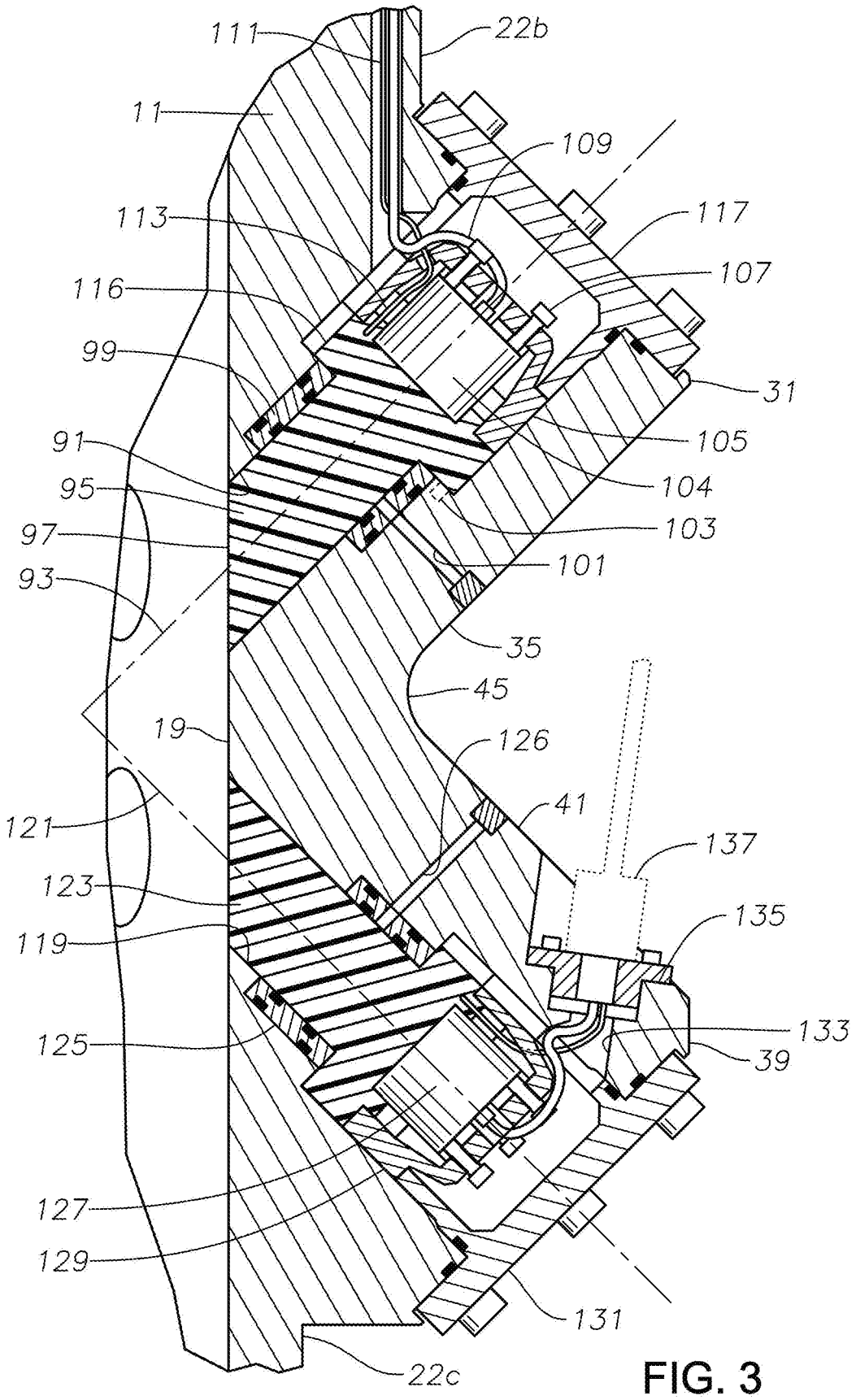
FIG. 3 is an enlarged sectional view showing an intermediate and a lower transducer of the transducer apparatus of FIG. 1.

As can be seen in FIG. 3, the transducer assemblies in intermediate rib 31 and lower rib 39 have many common features with the transducer assemblies in upper rib 23 (FIG. 2) that will not be mentioned again. A plurality of intermediate transducer bores 91 (only one shown in FIG. 3) extend downward and inward from intermediate rib upper sloping side 33. Intermediate transducer bore 91 has an axis 93 that intersects spool bore axis 21 (FIG. 1) at a 45 degree angle. A base 95, similar to base 51 (FIG. 2), fits within intermediate transducer bore 91. Base 95 has an inner end 97 that is flush with spool bore 19. In this example, because of the 45 degree inclination, inner end 97 is oblique to transducer bore axis 93, rather than normal.

A seal ring assembly 99 that has the same components as in FIG. 2 seals base 95 from the drilling fluid pressure within spool bore 19. A test port 101 extends from seal ring assembly 99 to intermediate rib lower sloping side 35. An anti-rotation pin 103 may extend parallel with axis 93 from a portion of base 95 into a mating hole in transducer bore 91. The transducer base in lower rib 39 may have a similar anti-rotation pin. An acoustic transducer wafer or element 104 is in contact with the outer end of base 95. Acoustic transducer element 104 sends acoustic signals through base 95 into the drilling fluid in spool bore 19. Particles, such as drilling cuttings, reflect signals back to transducer element 104. Computations may be made to determine the flow rate of the drilling fluid based on these signals.

A transducer housing 105 encloses but does not seal around transducer element 104 in the same manner as in FIG. 2. Screws 107 may be employed through the outer end of transducer housing 105 to push transducer element 104 tightly against the outer end of base 95.

A transducer cable 109 extends from the outer end of transducer element 104 through an opening in transducer housing 105 into a cable passage 111. A temperature sensor wire 113 extends from a temperature sensor in base 95 to cable passage 111. Cable passage 111 extends upward from upper transducer bore 91 through the part of the spool side wall at spool exterior portion 22*b*. As shown in FIG. 1, cable passage 111 extends through upper rib 23 and has an outlet with a conventional subsea connector 115 on upper rib upper surface 25. Cable passage 111 is circumferentially staggered relative to upper rib transducer bores 47 (FIG. 2) so that it passes between two of the upper rib transducer bores 47. Cable connector 115 is located circumferentially between adjacent upper rib cable connectors 85. The portion of the side wall of spool 11 through which cable passage 111 extends is thicker than the portions above upper rib 23 and lower rib 39 to accommodate cable passage 111.

Transducer cable 109 and temperature sensor cable 108 connect to one or more conventional subsea external cables at connector 115. In this example, cable passage 111 is parallel with spool bore axis 21. Locating cables 109, 108 within axially extending internal passages in the side wall of spool 11 avoids conflict with external structure (not shown) on spool 11, such as auxiliary pipes that deliver hydraulic fluid and serve as choke and kill lines for BOP 17 (FIG. 1).

Referring again to FIG. 3, a slot or groove 116 is formed on part of the cylindrical exteriors of housing 105 and base 95. Slot 116 is parallel with intermediate transducer bore axis 93. Slot 116 accommodates portions of cables 109 and 113 when transducer 104, housing 105 and base 95 are being retrieved from transducer bore 91 for maintenance. Upper transducer base 51 and housing 73 (FIG. 2) as well as the transducer assembly in lower rib 39 may have similar slots. A cap 117 secures to intermediate transducer bore 91 in the same manner as cap 87 of FIG. 2.

A plurality of circumferentially spaced apart lower transducer bores 119 (one shown in FIG. 3) extend from lower rib lower sloping side 43 upward and inward to spool bore 19. Lower transducer bore 119 has a lower transducer bore axis 121 that may intersect intermediate transducer bore axis 93 at a 90 degree angle. The point of intersection is outward from spool bore axis 21 (FIG. 1). As shown in FIG. 3, the lower transducer assemblies have many common features with the intermediate transducer assemblies that will not be mentioned again. A base 123 of the same material as bases 95 and 51 (FIG. 2) fits within lower transducer bore 119. A seal assembly 125 seals base 123 in the same manner as seal assembly 99. A test port 126 for seal assembly 125 extends to upper sloping side 41. A transducer element 127 mounts to the outer end of base 123. Transducer element 127 also provides and receives acoustic signals used to determine a flow rate of drilling fluid in spool bore 19. A housing 129 fits over and around transducer element 127 and secures by screws (not shown) to base 123. A cap 131 seals the outer end of lower transducer bore 119 and resists outward movement of base 123 in response to internal pressure in spool bore 19.

In this example, transducer and temperature sensor cables pass into a cable passage 133. Cable passage 133 extends upward from lower transducer bore 119 to a flat notch or outlet surface 135 formed in lower rib upper sloping side 41. A cable connector 137 secures to outlet surface 135 for connecting the transducer and temperature sensor cables to an external subsea cable. In this example, cable passage 133 is not quite parallel with spool bore axis 21 (FIG. 1), but it could be.

Figure 4:
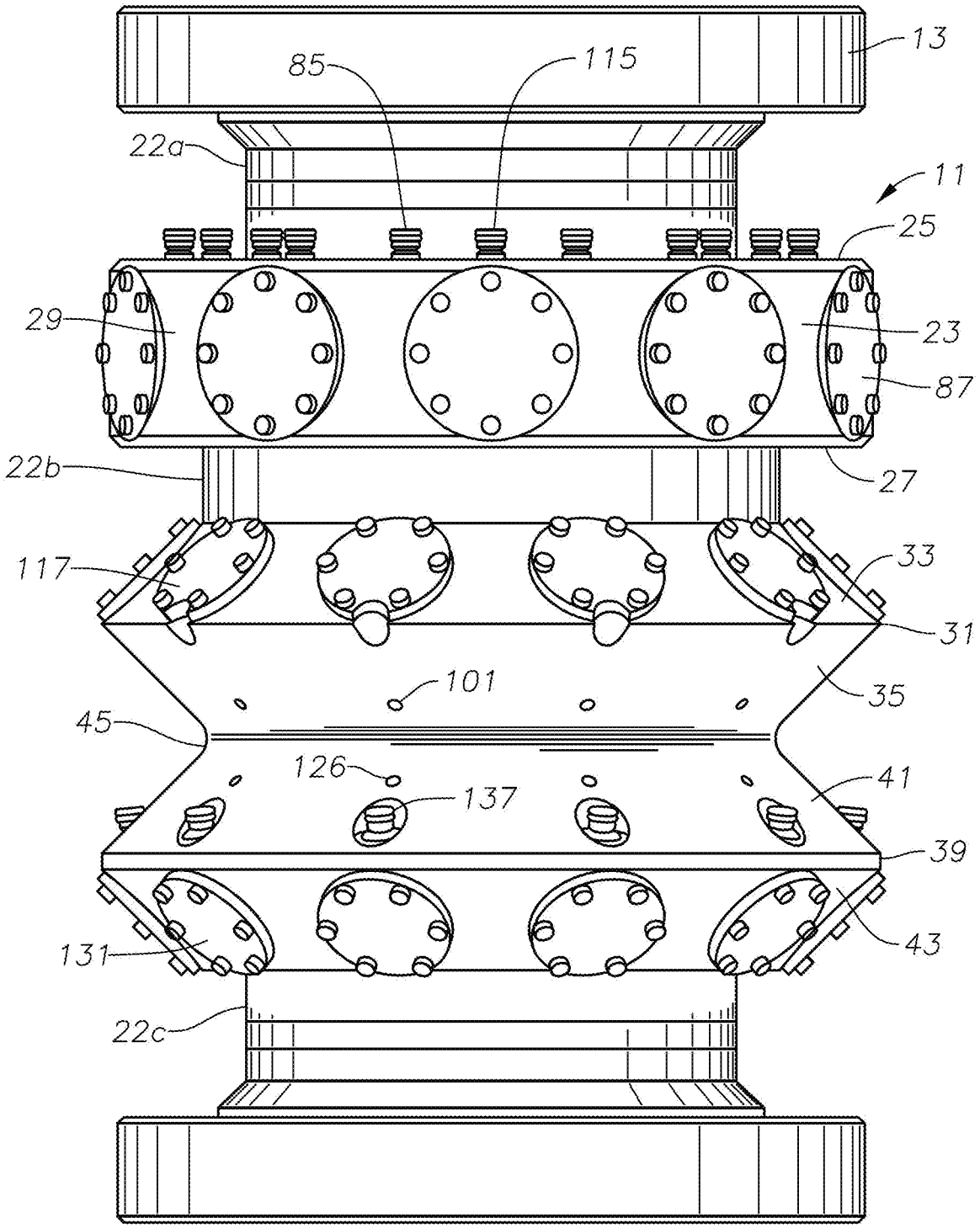
FIG. 4 is a side view of the transducer apparatus of FIG. 1.

FIG. 4 shows the exterior of spool 11. Caps 87, 117 and 131 illustrate the various locations for the transducer assemblies. V-shaped recess 45 provides a greater surface area of spool 11 between intermediate rib 31 and lower rib 39 than would a cylindrical space between the two ribs. The greater surface area enhances cooling of portions of spool 11 at ribs 31, 39 as it is immersed in sea water.

It is to be understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An apparatus for an offshore drilling riser, comprising:

a spool for connecting into the riser, the spool having a side wall with a spool bore and a longitudinal spool axis;

a first band extending around an exterior of the side wall concentric with the axis and formed as part of the side wall;

the first band having a first band upper sloping side that faces upward and outward relative to the spool axis, the first band having a first band lower sloping side that faces downward and outward relative to the spool axis;

a plurality of first band transducer bores extending from one of the upper and lower sloping sides through the first band and to the spool bore, each of the first band transducer bores having a transducer bore axis that is oblique relative to the spool bore axis; and a first band transducer mounted in each of the transducer bores for detecting a parameter of drilling fluid flowing through the spool bore.

2. The apparatus according to claim 1, further comprising:

a cable passage extending axially from each of the first band transducer bores and having an outlet on an exterior portion of the spool; and a transducer cable extending from each of the first band transducers through one of the cable passages for supplying power to and transmitting signals from each of the first band transducers.

3. The apparatus according to claim 2, further comprising:

a temperature sensor cable extending from each of the first band transducers through one of the cable passages.

4. The apparatus according to claim 1, wherein:

each of the first transducer bores extend downward and inward from the first band upper sloping side; and wherein the apparatus further comprises:

a second band extending around the exterior of the side wall below the first band concentric with the axis and formed as part of the side wall;

the second band having a second band upper sloping side that faces upward and outward relative to the spool axis, the second band having a second band lower sloping side that faces downward and outward relative to the spool axis;

a plurality of second band transducer bores extending upward and inward from the second band lower sloping side through the second band and to the spool bore, each of the second band transducer bores having a second band transducer bore axis that is oblique relative to the spool axis; and a second band transducer mounted in each of the second band transducer bores for detecting a parameter of the drilling fluid flowing through the spool bore.

5. The apparatus according to claim 4, wherein the lower sloping side of the first band joins the upper sloping side of the second band in a groove between the first and second bands.

6. The apparatus according to claim 4, further comprising:

a rib axially spaced from the first and second bands, the rib extending around the exterior of the side wall and formed as part of the side wall;

the rib having upper and lower sides that face upward and downward, respectively, and are joined by an external cylindrical surface;

a plurality of rib transducer bores extending radially inward from the cylindrical surface through the rib to the spool bore, each of the rib transducer bores having a rib transducer bore axis that is on a radial line of spool axis; and a rib transducer mounted in each of the rib transducer bores for detecting a presence of a drill pipe within the spool bore.

7. The apparatus according to claim 6, further comprising:

a cable passage extending axially from each of the first band transducer bores and having an outlet on one of the sides of the rib, the outlet being located circumferentially between adjacent ones of the rib transducer bores; and a cable extending from each of the first band transducers through one of the cable passages.

8. The apparatus according to claim 1, wherein each of the first band transducers comprise:

a base of a rigid non-metallic material having an inner end at the spool bore and an outer end within one of the first band transducer bores;

an acoustic transducer element mounted on the outer end of the base; and wherein an acoustic signal path extends through the base between the first band transducer elements and the spool bore.

9. The apparatus according to claim 8, further comprising:

a seal ring extending around and sealing between a cylindrical exterior portion of the base and one of the first band transducer bores;

a transducer retainer secured to the outer end of the base and enclosing the transducer element of each of the first band transducers; and a cap secured to an outer end of each of the first band transducer bores, the cap having a closed end spaced outward from the transducer retainer.

10. An apparatus for an offshore drilling riser, comprising:

a spool for connecting into the riser, the spool having a side wall with a spool bore and a longitudinal spool axis;

a transducer bore extending from an exterior portion of the side wall to the spool bore;

a base of a rigid non-metallic material having an inner end at the spool bore and an outer end within the transducer bore;

a seal ring extending around and sealing between a cylindrical exterior portion of the base and the spool bore;

a transducer element mounted on the outer end of the base;

a transducer retainer enclosing the transducer element, the transducer retainer having an inner end secured to the outer end of the base; and a cap secured and sealed to an outer end of the transducer bore, the cap having a closed end spaced outward from the transducer retainer.

11. The apparatus according to claim 10, wherein:

the transducer retainer has a cylindrical portion surrounding the transducer element and an outer end spaced outward from an outer end of the transducer element; and a washer is located between and in contact with the outer end of the transducer element and the outer end of the transducer retainer.

12. The apparatus according to claim 10, further comprising:

a cable passage extending axially from the transducer bore to an exterior portion of the spool; and a transducer cable extending from the transducer element through the transducer retainer and into the cable passage.

13. The apparatus according to claim 10, wherein:

the transducer retainer has a cylindrical portion surrounding the transducer element and an outer end spaced outward from an outer end of the transducer element; and a plurality of screws extend through holes in the outer end of the transducer retainer into contact with the transducer element, the screws exerting a force on the transducer element against the base.

14. The apparatus according to claim 10, wherein:

the transducer bore has an inner portion and an outer portion, the outer portion having a larger diameter than the inner portion, defining an outward facing shoulder; and the base has an inner cylindrical portion and an outer cylindrical portion, the inner cylindrical portion having a larger diameter than the outer cylindrical portion, defining an inward facing shoulder that abuts the outward facing shoulder.

15. The apparatus according to claim 14, wherein a slot extends along the outer cylindrical portion of the base and a cylindrical portion of the transducer retainer.

16. An apparatus for an offshore drilling riser, comprising:

a spool for connecting into the riser, the spool having a side wall with a spool bore and a longitudinal spool bore axis;

a protrusion extending around the side wall concentric with the spool bore axis and formed as part of the side wall;

upper and lower sloping surfaces on the protrusion, the upper sloping surface facing upward and outward, the lower sloping surface facing downward and outward;

a recess extending around the protrusion between the upper and lower sloping surfaces;

a plurality of upper transducer bores spaced around the protrusion and extending from the upper sloping surface downward and inward into the spool bore;

a plurality of lower transducer bores spaced around the protrusion and extending from the lower sloping surface upward and inward into the spool bore;

a base in each of the upper and lower transducer bores, the base having an inner end at the spool bore and an outer end within one of the upper and lower transducer bores, the base being formed of a rigid non-metallic material;

a seal ring between a cylindrical exterior portion of each of the bases and one of the upper and lower transducer bores; and a transducer element mounted to the outer end of each of the bases.

17. The apparatus according to claim 16, further comprising:

a cable passage extending axially from each of the upper transducer bores to an outlet on an exterior portion of the spool; and a transducer cable extending from each of the transducer elements in the upper transducer bores through one of the cable passages.

18. The apparatus according to claim 17, further comprising:

a temperature sensor mounted to each of the bases; and a temperature sensor cable extending from each of the temperature sensors through one of the cable passages.

19. The apparatus according to claim 16, further comprising:

a rib axially spaced from the protrusion, the rib extending around the exterior of the side wall concentric with the spool bore axis and formed as part of the side wall;

the rib having upper and lower sides that face upward and downward, respectively, and are joined by an external cylindrical surface of the rib;

a plurality of rib transducer bores extending radially inward from the cylindrical surface of the rib to the spool bore, each of the rib transducer bores having a rib transducer bore axis that is perpendicular to and intersects the spool bore axis;

a rib transducer base in each of the rib transducer bores, each of the rib transducer bases having an inner end at the spool bore and an outer end within one of the rib transducer spool bores, each of the rib transducer bases being formed of a rigid non-metallic material;

a seal ring extending around and between a cylindrical exterior portion of each of the rib transducer bases and one of the rib transducer bores; and a rib transducer element mounted to the outer end of each of the rib transducer bases.

20. The apparatus according to claim 19, further comprising:

a cable passage extending axially through the side wall from each of the upper transducer bores through the rib to an outlet on the upper side of the rib; and a transducer cable extending from each of the transducer elements in the upper transducer bores into one of the cable passages.

* * * * *